United States Patent [19]

Normann et al.

[11] 4,389,083

[45] Jun. 21, 1983

[54] ELECTRICAL CONNECTOR ASSEMBLY

[75] Inventors: Richard W. Normann, Otego; Paul D. Niles, Bainbridge, both of N.Y.

[73] Assignee: The Bendix Corporation, Southfield, Mich.

[21] Appl. No.: 365,846

[22] Filed: Apr. 5, 1982

Related U.S. Application Data

[62] Division of Ser. No. 137,228, Apr. 4, 1980, Pat. No. 4,342,494.

[51] Int. Cl.[3] ..... H01R 13/58

[52] U.S. Cl. ..... 339/105; 29/835; 339/106

[58] Field of Search ..... 339/206, 207, 208, 210, 339/105, 106, 107, 47 R, 49 R; 29/835, 864

[56] References Cited

U.S. PATENT DOCUMENTS 2,461,980 2/1949 Hansen ..... 339/47 R
3,753,214 8/1973 Du Rocher et al. ..... 339/206 R X
4,076,365 2/1978 Ross et al. ..... 339/107

*Primary Examiner*—Eugene F. Desmond
*Attorney, Agent, or Firm*—Charles D. Lacina

[57] ABSTRACT

An electrical connector assembly (10) and method of making wherein the connector does not require a separate contact but comprises end strands (52) of a multistranded electrical conductor (wire 50). The strands (52) are formed into a loop (56) having overlapping portions (57) and the overlapping portions are secured together by a weld. The forward portion of the strands (52) are straightened into axial alignment and the ends (53) of each strand cut and provided with angled end surfaces (54). The conductor (wire) so prepared is inserted into a molded housing (20) having two mating halves (30, 40), at least one of which is provided with a channel (33) including a loop cavity (62) and a projection (60). The loop (56) of the conductor is mounted over the projection and the two connector halves secured together to complete the connector assembly.

9 Claims, 14 Drawing Figures

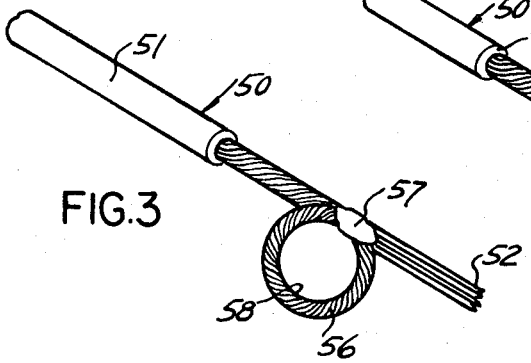
FIG.3
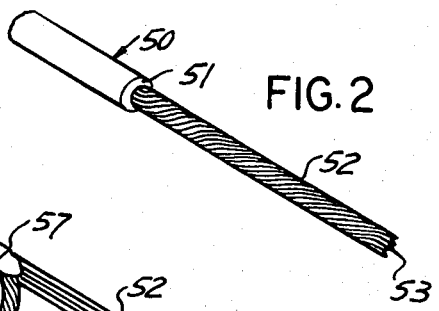
FIG.2
FIG.4
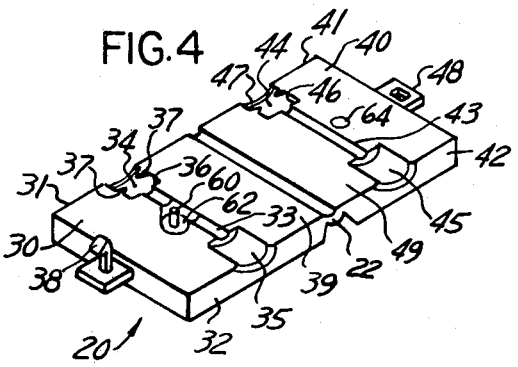
FIG.5
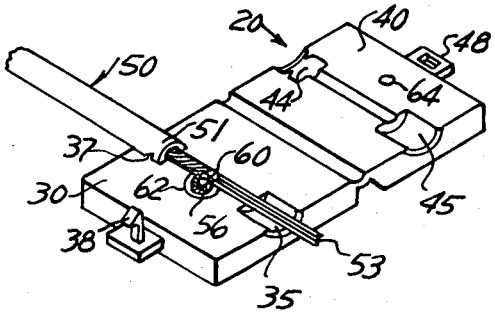
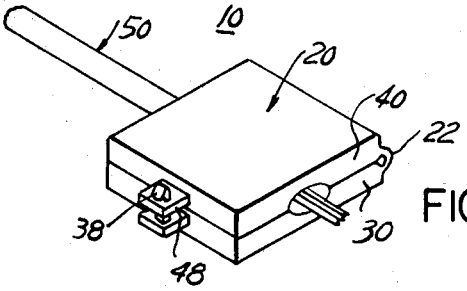
FIG. 1

FIG. 6
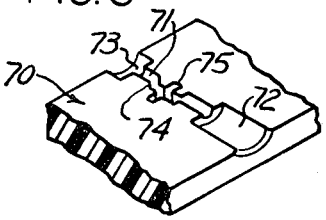
FIG. 8
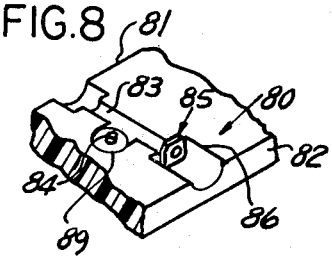
FIG. 7
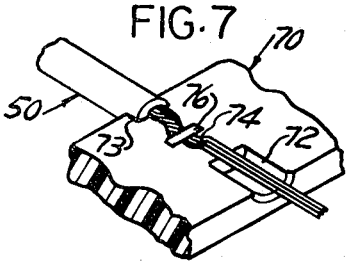
FIG. 9
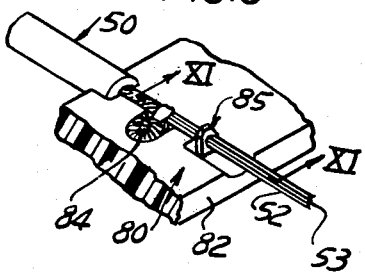
FIG. 10
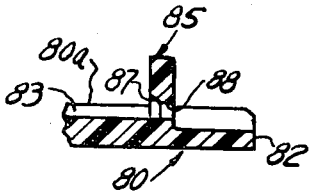
FIG. 11
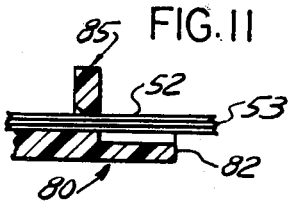
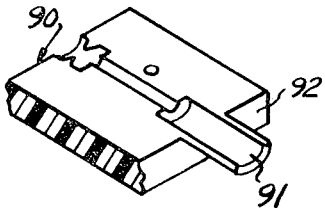
FIG. 12
FIG. 13
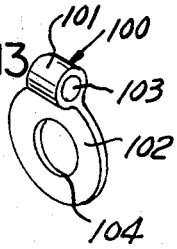
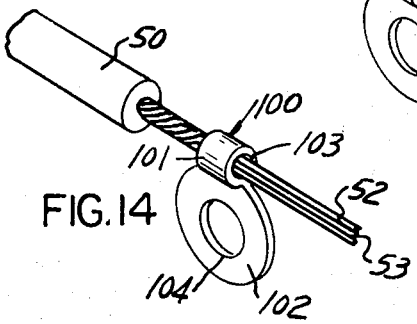
FIG. 14

ELECTRICAL CONNECTOR ASSEMBLY

This is a division of application Ser. No. 137,228 filed Apr. 4, 1980, now U.S. Pat. No. 4,342,494, issued Aug. 3, 1982.

TECHNICAL FIELD

This invention relates to electrical connectors and more particularly to a method and apparatus for making a contactless electrical connection.

BACKGROUND OF THE INVENTION

Many electrical contacts are known in the prior art for terminating a conductor for mating. One such contact is shown in U.S. Pat. No. 3,725,844 and entitled "Hermaphroditic Electrical Contact". Other contacts are shown in U.S. Pat. Nos. 4,120,556 and 4,072,394. Such prior art contacts provide an adequate termination for an electrical conductor but have the disadvantage that they require separate manufacture and installation to each conductor. Separate manufacture and installation is undesirable in many instances.

It has been proposed that the conductor termination be eliminated and that with suitable preparation of the conductor, and a rather minor part, that the conductor itself can be an integral contact. Such a system is disclosed in U.S. patent application Ser. No. 890,339 and entitled "Electrical Connector Assembly", the specification and drawings thereof incorporated herein by reference. Even this system has the undesirable feature that an additional part is necessary to be manufactured and assembled to the conductor before the conductor can be its own contact. The manufacture of a system requiring additional components involves additional expenditure. Further, the system disclosed in the referenced "Electrical Connector Assembly" application presupposes that the conductor will be of a fixed size to be secured within the passage. This is not always the case and might present a problem.

Accordingly, the prior art contacts known in the art, have limitations and disadvantages. One disadvantage is that they must be securely fastened to the electrical wire strand. As the number of interconnections required between units to be mated increases, the integrity of electrical interconnection between each strand and contact becomes questionable. A more desirable electrical interconnection joins only a minimum number of electrical terminations.

DISCLOSURE OF THE INVENTION

The present invention overcomes the limitations and disadvantages of the prior art contacts and contactless conductors by providing an assembly which is easy to manufacture and prepare and provides a connector assembly which is relatively inexpensive while providing a quality contact and coupling for a conductor.

The present invention is characterized by a insulated conductor wire (50) which has had a forward portion of insulator (51) removed to expose a plurality of conductive strands (52). The conductive strands (or conductor) are formed into a loop (56) in the forward region rearwardly of the ends (53) and having overlapping portions (57) which are secured together. The strands are straightened and the ends (53) thereof provided with an acutely angled end surface (54) at a uniform forward distance. The looped conductor is then inserted into a channel (33) of a molded housing (20) base portion (30) and over a projection (60) disposed in a loop cavity (62) between front and rear faces (32, 31) of the base, the projection positioning the conductor therein and providing strain relief therefor. A cover portion (40) is affixed over the housing to secure the conductor wire therein.

Other objects and advantages of the present invention will be apparent to one skilled in the art in view of the following detailed description of the invention and the claims and the accompanying drawings.

BRIEF DESCRIPTION OF THE DRAWINGS

FIG. 1 shows a contactless electrical connector assembly according to the invention;

FIG. 2 shows an electrical conductor wire having a forward portion of insulation removed to expose a plurality of conductive strands;

FIG. 3 shows the conductor wire of FIG. 2 with the conductive strands formed into a loop;

FIG. 4 shows a molded insulative housing according to one embodiment of the invention;

FIG. 5 shows the housing of FIG. 4 receiving the conductor wire of FIG. 3;

FIG. 6 shows another molded insulative housing according to the invention;

FIG. 7 shows the insulative housing of FIG. 6 receiving the electrical conductor wire of FIG. 2;

FIG. 8 shows yet another molded insulative housing according to the invention;

FIG. 9 shows the insulative housing of FIG. 8 receiving the electrical conductor wire of FIG. 3;

FIG. 10 is a side view in section of the insulative housing of FIG. 8.

FIG. 11 is a side view in section taken along line XI—XI of FIG. 9;

FIG. 12 shows yet another molded insulative housing according to the invention.

FIG. 13 shows a conductive ring according to the invention, and

FIG. 14 shows the ring of FIG. 13 assembled with the conductor wire of FIG. 2.

DETAILED DESCRIPTION OF THE INVENTION

Turning first to FIG. 1, a contactless electrical connector assembly 10 is shown assembled and comprises an insulating body 20 enclosing a multi-stranded electrical conductor wire 50.

FIG. 2 shows the conductor wire 50 including a plurality of conductive strands 52 protectively surrounded by an outer insulative jacket 51. A forward portion of the insulation has been removed to expose a forward end 53 of the strands. When a manufacturer supplies the multi-stranded conductor wire 50 the conductive strands within the jacket are normally twisted and hence must be combed into axial alignment for use herein.

FIG. 3 shows the conductive strands 52 formed into a loop 56 defining a loop aperture 58 within the forward end region having overlapping portions 57, the overlapping portions being secured together by a suitable method such as soldering or welding. The untwisted, exposed forward end 53 of each conductive strand is provided with an acutely angled end surface at a uniform forward distance from the insulative jacket. One device for untwisting and cutting the strands to provide the angled end surfaces is disclosed in a concurrently filed patent application disclosure 370-78-0380 and entitled "Method of Making Contactless Connector."

FIG. 4 shows the insulating body 20 according to one aspect of this invention. The body 20 is a unitary structure and includes a base 30 and a cover 40 integrally joined together by a contiguous hinge 22 longitudinally extending along the full length of one side of each body half. The insulating body is preferably molded in a known manner from a synthetic polymeric material having adequate insulating and strength characteristics upon being molded or formed as will occur to those skilled in the art. The hinge 22 of the preferred embodiment may be formed with reduced thickness so as to provide increased flexibility facilitating repeated opening or closing of the cover 40 relative to the base 30.

The base 30 includes a top surface 39, a rear face 31, a front face 32 and a wire receiving channel 33 extending between the faces, channel 33 including enlarged recesses 34, 35 adjacent each respective face 31, 32. As shown, recess 34 defines an undercut on surface 39 for receiving the insulated portion of the conductor wire and includes an abutment 36 for limiting the inward position of the conductor wire and a pair of barbs 37 extending outwardly from a wall of the recess to retain the conductor wire in the recess and to the base. Recess 35 defines another undercut on surface 39 for receiving the angled ends of the conductor wire and defines a cavity for receiving a mateable end of another connector (not shown) to complete an electrical interconnection.

Similarly, cover 40 includes a top surface 49, a rear face 41, a front face 42 and a wire receiving channel 43 extending between the faces 41, 42, channel 43 including recess 44, 45 adjacent each respective face 41, 42. Recesses 44 and 45 define undercuts in surface 49 for receiving the insulated portion and the angled ends of the wire respectively. Recess 44 includes an abutment 46 and, depending on the application, may or may not include wire retaining barbs 47.

Latching means serve to secure the cover 40 to the base 30 and includes a latch 38 and a latch receiver 48.

Preferably, and in accord with the present invention, base 30 further includes a projection or strain relief post 60 disposed intermediate the recesses 34, 35 and adjacent the wire receiving channel 33, the post extending generally perpendicularly upward from the top surface 39 of the base 30 and located within a post cavity 62 adjacent to and contiguous with the channel 33. Post 60 and post cavity 62 are sized to accommodate the loop portion 56 of the electrical conductor wire, aperture 58 of the loop 56 fitting snugly around the post 60 and loop 56 fitting within the post cavity 62. Cover 40 includes a bore 64 adapted to receive the end of post 60 when the cover is latched onto the base thereby providing rigidity to the post and to the connection.

FIG. 5 shows the electrical conductor wire 50 being secured into the base 30 of the housing 20 with the insulation portion 51 being received in the rear recess 34 and retained by the barbs 37, the loop 56 being fit about the projection 60 and within the post cavity 62 and the angled wire ends 53 extending into the front (mating) recess 35. The housing 20 and conductor 50 are now ready to be assembled into the electrical connector assembly 10 shown in FIG. 1.

FIG. 6 shows another embodiment wherein an insulative base 70 includes a wire receiving channel 71 having a front recess 72, a rear recess 73 and a wire passage extending between the recesses, the wire passage including an offset strain relief portion 74 intermediate the front and rear recesses. The strands of the conductor wire 52 are bent to conform with and fit into the offset portion 74. A slot 75 transverse to the channel 71 receives a staple 76 or other suitable means for securing the strands to the base 70.

FIG. 7 shows the base 70 having the conductive wire strands fitted within the off-set and the staple 76 securing the wire to the base.

FIG. 8 shows another embodiment wherein a base 80, similar to base 40, includes a top surface 80*a*, a front face 82, a rear face 81, a conductor receiving channel 83, extending between the faces, a loop post 84 disposed between the faces and further includes a flange 85 disposed in the channel between the post 84 and the front face 82, the flange extending perpendicularly to the base 80 and including a bore 86 for receiving the conductive strands of the conductor wire, the bore being substantially axially aligned with the conductor receiving channel.

FIG. 9 shows base 80 of FIG. 8 receiving the conductor wire and having the conductive strands disposed in the bore 86 of the strain relief flange 85.

FIGS. 10 and 11 show the flange 85 in section, the bore 86 including an inwardly flaring portion 87 for receiving the bundle of conductive strands and a second constant diameter portion 88 which faces the front face 82. The constant diameter portion 88 of the flange holds the strands in alignment when the strands mate with another connector.

FIG. 12 shows yet another embodiment according to this invention wherein a base 90 includes a shroud or male member 91 extending from the front face 92 of the base for inter-mating with a female connector, such as could be formed by recesses 35, 45 of the insulating body 20.

FIG. 13 shows a securement member 100 having a sleeve portion 101 and a ring portion 102 extending transversely to the sleeve, the sleeve being adapted to be inserted about the axially aligned combed plurality of conductive strands 52 of the conductor 50. As shown in FIG. 14, the sleeve is crimped or otherwise secured to the strands to provide strain relief to the bundle and the combination used with, for example, the base 30 of FIG. 4. The securement member 100 may be of conductive or of non-conductive material. If the housing channel were properly sized, the sleeve alone would be sufficient for retention and the ring portion eliminated.

When the strands have been assembled into a bundle, each forward end portion of the strand is axially aligned and disposed in generally parallel side-by-side relation, the bundle end defining a mateable "hermaphroditic" electrical contact. Although for purposes of illustration and strand ends have been shown extending beyond the front mating face of the housing, typically the ends would be protectively enclosed within the recesses or shrouds.

While FIG. 1 shows an electrical connector having only one contactless conductive (wire) member, it is to be understood that a plurality of conductive (wire) members could be provided in side-by-side relation. Further, although a hinged member secured the based and the cover in FIG. 3, the two body halves could be ultrasonically bonded together if desired.

OPERATION

To provide a contactless electrical connector 10 in accord with the present invention, one illustrative method will now be described. First, provide or form an insulative connector body 20 having two mateable body halves, such as a base 30 and a cover 40, and having a conductor receiving channel 33, 43 the channel being formed either in one body only or with each body half including a portion of the wire receiving channel, the portions on one half being adapted to confront with the portions on the other half when the halves are mated to form a contact receiving and retaining channel. Between front and rear faces of the body, provide a projection 60 within a recess cavity 62. Take a plurality of conductive strands 52, such as would be provided in a multi-stranded electrical conductor wire 50, remove a forward end portion of the insulation of the wire to expose the strands. Bend the conductor rearwardly of the forward end of the strands into a loop to develop an overlapping portion 57. Secure the overlapping portions together as by welding thereby forming a rigid loop. Arrange the forward end of the strands into axial alignment and cut the forward ends of the strands so as to provide them with acutely angled ends. Although any suitable apparatus will suffice, a wire cutter is disclosed in the above referenced "Method of Making Contactless Connector". Insert the conductor wire with loop into the channel of one connector half so that the strands extend through the channel and the loop is disposed about the projection. Finally, secure the connector body halves together to form a completed electrical connector assembly.

Having thus described the invention, what is claimed is:

1. In combination, a contactless electrical connector comprising:

an insulative housing including two mateable body halves having forward and rear faces with at least one of said body halves including a conductor receiving channel therein, said channel including a first recess portion extending from the rear face forwardly, a second recess extending from the forward face rearwardly and a passage connecting the two recess portions and having an intermediate portion offset from an imaginary line passing through the recesses;

a conductor including an insulative jacket surrounding plurality of conductive wires, said conductor having the insulative jacket removed from a forward end to expose the conductive wires, the exposed wires being arranged in axial alignment, said wires having a first forward end portion extending into the channel of the housing and a second rearward portion extending into the intermediate offset portion of the passage;

means for preventing axial movement of the wires in the passage; and means for securing the housing body halves together.

2. The contactless electrical connector of claim 1 wherein said means for securing the conductive wires in the passage comprises a slot transverse to said passage intermediate portion and a staple adopted to be received within the slot and about the strands of the wire and thereby secure the strands in the channel.

3. A contactless electrical connector comprising:

an insulative housing including a pair of mateable bodies having a forward face, a rear face, and with at least one of said bodies having a conductor receiving channel extending between the faces, a projection disposed intermediate the faces and adjacent the channel and a loop cavity extending around the projection;

an electrical wire having an insulative jacket surrounding a plurality of conductive strands, the wire having a forward end portion of the insulation removed to expose the conductive strands and the exposed strands being axially straightened for mounting within the channel of the housing;

conductive means for mounting the strands in the housing, said conductive means being secured about the exposed strands; and means for securing the pair of bodies together to retain the strands in the passage and the ring extending around the projection.

4. A contactless connector as recited in claim 3 wherein the conductive means comprises a conductive sleeve secured rearwardly of the forward end of the strands, the conductive sleeve including a ring extending transversely therefrom with said ring being adapted to fit over the projection and be secured therearound.

5. In an electrical connector assembly of the type having a housing of insulative material mounting a mateable contactless connector formed from a plurality of exposed conductive wires of a multi-stranded electrical conductor wire:

a base member having a pair of oppositely disposed faces and a wire receiving channel extending between the faces;

a cover member removably attached to the base member;

said exposed conductive wires having a forward mateable end portion comprised of axially straightened strands and a formed portion spaced rearwardly of the mateable end portion;

retention means axially offset from said channel for receiving the formed portion and preventing axial movement of the exposed conductive wires in the channel; and means for securing the base member to cover member to thereby retain the wires in the housing and form the connector assembly.

6. The assembly as recited in claim 5 wherein said formed portion is a loop and said retention means for receiving the formed portion and preventing axial movement comprises a post located intermediate the faces and extending upwardly from the base member and a post cavity disposed adjacent to the channel and in surrounding relation to the post, said loop being fit around the post and within the post cavity.

7. The assembly as recited in claim 5 wherein said means for preventing axial movement comprises a wire receiving passage being offset from and interconnected with the wire receiving channel and the formed portion of said wire being shaped to fit within the offset passage.

8. The assembly as recited in claim 7 wherein said means for preventing axial movement further comprises a slot disposed transversely of the passage and staple adapted to fit within the slot and secure the wires in the housing.

9. A method of making an electrical connector comprising the steps of:

forming an insulative body having forward and rear end faces a conductor receiving channel extending between the faces, said channel including a medial wire cavity axially offset from and interconnecting a first recess extending from the rear face forwardly and a second recess extending from the forward face rearwardly;

providing an electrical cable of the type having an outer jacket of insulation surrounding a plurality of twisted conductive strands;

removing the forward end portion of cable insulation to thereby expose a length of twisted conductive strands;

untwisting part of the exposed length of twisted conductive strands from their forward end rearwardly, whereby the exposed length includes a transitional strand part between twisted and untwisted strand parts;

bending the transitional strand part into a strand form offset from the axis defining the untwisted conductive strands;

inserting the conductive strand parts into the channel of the connector body, the twisted part being disposed in the first recess, the untwisted strand part disposed in the second recess portion and the offset strand form disposed in the wire cavity; and securing another insulative body to the first insulative body to retain the stranded wire parts in the channel.

* * * * *